United States Patent [19]

Dewill

[11] Patent Number: 4,867,232

[45] Date of Patent: Sep. 19, 1989

[54] FLUID FLOW CONTROL VALVE

[75] Inventor: John M. Dewill, Sarnia, Canada

[73] Assignee: Fiberglas Canada Inc., Toronto, Canada

[21] Appl. No.: 49,357

[22] Filed: May 14, 1987

[30] Foreign Application Priority Data

Jul. 10, 1986 [CA] Canada ..... 513502

[51] Int. Cl.[4] ..... F28F 27/00

[52] U.S. Cl. ..... 165/96; 137/625.43; 137/625.46; 251/162

[58] Field of Search ..... 165/96; 137/625.43, 137/625.46, 874; 251/162, 163

[56] References Cited

U.S. PATENT DOCUMENTS

| | | | |
|---|---|---|---|
| 406,447 | 8/1889 | Kennedy | 137/874 |
| 416,391 | 12/1889 | Baird | 137/874 |
| 653,600 | 7/1900 | Wiley | 137/609 |
| 721,743 | 3/1903 | Richmond | 137/874 |
| 1,681,328 | 8/1928 | Erickson | 137/874 |
| 2,252,141 | 8/1941 | Seidel | 251/73 |
| 2,443,995 | 6/1948 | Snyder | 251/162 X |
| 2,557,460 | 6/1951 | Ott | 251/73 |
| 2,624,364 | 1/1953 | Detlefsen | 137/609 |
| 2,825,604 | 3/1958 | Sebestyen | 406/182 |
| 2,898,932 | 8/1959 | Tefs | 137/340 |
| 3,089,515 | 5/1963 | Bochan | 137/610 |
| 3,132,669 | 5/1964 | Feldsted | 137/625.48 |
| 3,395,731 | 8/1968 | Kauffman | 137/610 |
| 3,527,252 | 9/1970 | Cook et al. | 137/608 |
| 3,581,768 | 6/1971 | Conti | 137/874 |
| 3,834,418 | 9/1974 | Clancy | 137/625.48 |
| 3,964,517 | 6/1976 | Dickenson | 137/625.43 |
| 3,995,446 | 12/1976 | Eubank | 137/625.46 X |
| 4,019,535 | 4/1977 | Buckethal | 137/625.15 |
| 4,063,572 | 12/1977 | Anderegg et al. | 137/625.46 |
| 4,223,700 | 9/1980 | Jones | 137/874 |
| 4,442,865 | 4/1984 | Shigeo | 137/874 |
| 4,469,135 | 9/1984 | Gray | 137/874 X |
| 4,653,536 | 3/1987 | Buhrman | 137/625.43 |

FOREIGN PATENT DOCUMENTS

| | | |
|---|---|---|
| 648861 | 9/1962 | Canada . |
| 663020 | 5/1963 | Canada . |
| 765564 | 8/1967 | Canada . |
| 792039 | 8/1968 | Canada . |
| 842498 | 5/1970 | Canada . |
| 850449 | 9/1970 | Canada . |
| 937125 | 11/1973 | Canada . |
| 1030511 | 5/1978 | Canada . |

*Primary Examiner*—Ira S. Lazarus
*Assistant Examiner*—Peggy Neils
*Attorney, Agent, or Firm*—Surhrue, Mion, Zinn, Macpeak and Seas

[57] ABSTRACT

A fluid flow control valve for use, in particular, in a heating and cooling system for a building, enables change-over of interconnections between ducts connected to rooms of the building and to the exterior and ducts connected to a heat recovery module for adapting the system to summer or winter operation. The control valve has a member rotatable about a predetermined axis of rotation between first and second positions, stationary first ducts distributed around the axis, flexible second ducts for communication with respective ones of the first ducts, the second ducts each having an end secured to the rotary member for movement therewith from one to another of the first ducts, and seals for sealing the second ducts to the first ducts.

15 Claims, 4 Drawing Sheets

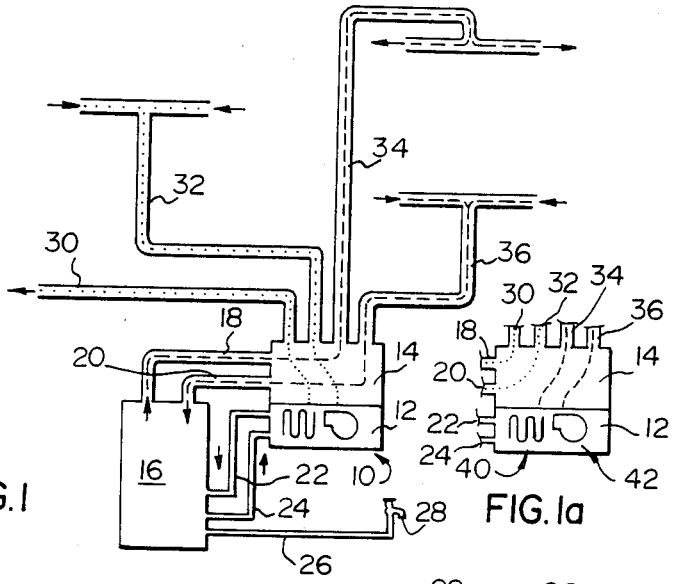
FIG. 1
FIG. 1a
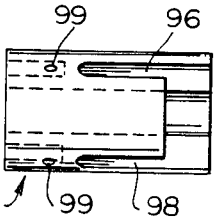
FIG. 4
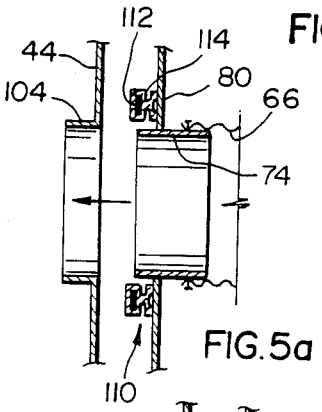
FIG. 5a
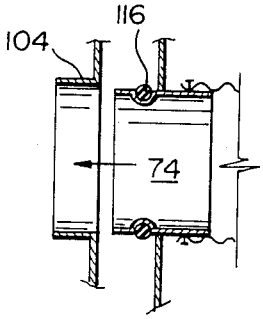
FIG. 5b
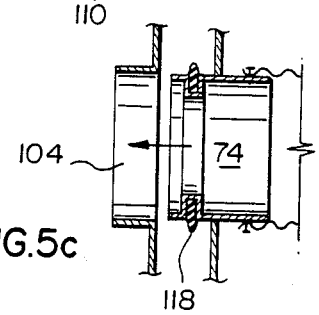
FIG. 5c

FLUID FLOW CONTROL VALVE

FIELD OF THE INVENTION

The present invention relates to fluid flow control valves and is useful, in particular, for interconnecting air ducts in such a manner as to permit changeover of the interconnections of such ducts.

BACKGROUND OF THE INVENTION

The present fluid flow control valve is useful in particular, but not exclusively, in a heating and cooling system for a building.

More particularly, it is proposed to provide a heating system for a building, and in particular for a domestic dwelling, which has air ducts extending from various rooms in the building to the control valve, an air duct extending from the control valve to the exterior of the building and further air ducts connecting the control valve to a heat recovery module. Actuation of the control valve permits the interconnection of the various air ducts to be changed in order to adapt the system for winter operation, in which heat is conveyed through the air ducts to some of the rooms, and summer operation, in which heat is extracted from the rooms and expelled to the exterior.

For this and for other applications, there exists a need for a fluid flow control valve which will enable a plurality of interconnections to be changed simultaneously.

DESCRIPTION OF THE PRIOR ART

In U.S. Pat. No. 3,527,252, issued Sept. 8, 1970 to G. R. Cook et al., there is disclosed a tube switching device which employs flexible tubes fixedly secured at one end to stationary tubes of a tube system and linearly reciprocable at their other ends between corresponding ends of a common stationary tubes forming part of the tube system. For moving the ends of the flexible tubes, suitable drives, such as pneumatic, hydraulic, electromagnetic or mechanical drives, are connected by rods to the movable tube ends to reciprocate the latter. Each tube end is provided with a respective drive, so that the movable tube ends can be displaced, one at a time, into registration with the stationary tube end. This prior tube switching device, therefore, has the disadvantage that it cannot be employed to effect simultaneous changeover of a plurality of tube of duct interconnections but, on the contrary, is capable only of a single changeover at one time. Moreover, each of the movable tube ends must be provided with its own drive, so as to be independently displaceable, and consequently it is not possible to employ a single drive or other mechanism for displacing all of the tube ends.

U.S. Pat. No. 3,834,418, issued Sept. 10, 1974 to James Roger Clansy, discloses a fluid flow control valve having a single port which can be connected selectively to one or the other of a pair of ports by displacement of one end of a flexible duct. A sealing arrangement automatically effects a seal between the movable duct end and a respective one of the ports when they are aligned and a pneumatical hydraulic ram is provided for effecting linear movement of the movable duct end between the pair of ports. Again, this prior control valve suffers from the disadvantage that it enables only a single changeover to be effected and does not in any way suggest means for simultaneously producing a plurality of duct connection changeovers.

It has also been proposed to provide a control valve or switch which enables interconnections of ducts or pipes to be changed by rotation of a rotary member so as to bring one end of a tube carried by the rotary member into alignment with one or the other of a pair of stationary tube or duct ends. Such devices are disclosed, for example, in U.S. Pat. No. 2,825,604, issued Mar. 4, 1958 to E. J. Sebestyen; U.S. Pat. No. 3,581,768, issued June 1, 1971 to Robert F. Conti; U.S. Pat. No. 4,063,572, issued Dec. 20, 1977 to Hans Rudolf Anderegg et al. and U.S. Pat. No. 4,223,700, issued Sept. 23, 1980 to Marvin R. Jones. These prior art devices, however, do not employ flexible ducts and, therefore, require either that a non-flexible duct which is movable for effecting the changeover has one end thereof located on the axis of rotation of the device, thus restricting the device to the provision of only one such duct, or, alternatively, these prior devices require the or each movable but nonflexible duct to have both of its ends offset from such axis of rotation, so that both ends are necessarily displaced out of alignment with respective ports upon rotation of the or each duct.

BRIEF SUMMARY OF THE INVENTION

In contrast to these prior arrangements, the employment of flexible ducts offers the advantage that each flexible duct may have one end thereof fixedly connected to a corresponding stationary duct and, furthermore, allows such fixed end of the flexible duct to be located at any convenient position, rather than necessarily being on the axis of rotation of the device.

It is, accordingly, an object of the present invention to provide a novel and improved fluid flow control valve which overcomes the above-discussed disadvantages of prior art valves.

It is a further object of the invention to provide a fluid flow control valve provided with a plurality of flexible ducts which are each fixed at one end and which have other ends which can be rotated to effect simultaneous changeover of a plurality of duct interconnections.

According to the present invention, there is provided a fluid flow control valve comprising a fluid flow control valve, comprising a rotary member mounted for rotation about a predetermined axis of rotation, means for rotating the rotary member to and for about the axis of rotation between first and second positions, a plurality of stationary first ducts distributed about the axis of rotation, a plurality of flexible second ducts for communication with respective ones of the first ducts, the second ducts each having a first end movable from one to another of the first ducts on rotation of the rotary member from the first position to the second position, and means for releasably sealing the first ends of the second ducts to respective ones of the first ducts.

By thus utilizing a plurality of flexible second ducts, a plurality of interconnections can be simultaneously changed over by the rotation of the rotary member between its first and second positions. Moreover, for this purpose, it is necessary to employ only a single drive mechanism, which may be a manual drive mechanism, for rotating the rotary member, so that the construction of the control valve can be simplified by the avoidance of a plurality of pneumatic, electromagnetic or other energizable drives and so that, consequently, the cost of manufacturing of the control valve can be kept low and, furthermore, the control valve is reliable in operation and durable.

Preferably, housing means are provided for enclosing the second ducts in a fluid-type manner, the rotary member defining an additional opening communicating with the interior of the housing means and movable to selectively connect either one of a pair of the first ducts to the interior of the housing means by the rotation of the rotary member between the first and second positions, blower means being provided for impelling air from the interior of the housing means through one of the second ducts and means being provided within the housing means for modifying the temperature of the air during the passage of the air from the additional opening to said one of the second ducts.

BRIEF SUMMARY OF THE INVENTION

The invention will be more readily understood from the following description of a preferred embodiment thereof given, by way of example, with reference to the accompanying drawings, in which:

FIG. 1 shows a diagram of a heating and cooling system for a house with the system adjusted for summer operation;

FIG. 1*a* shows a portion of the system of FIG. 1, adjusted for winter operation;

Figure 2:
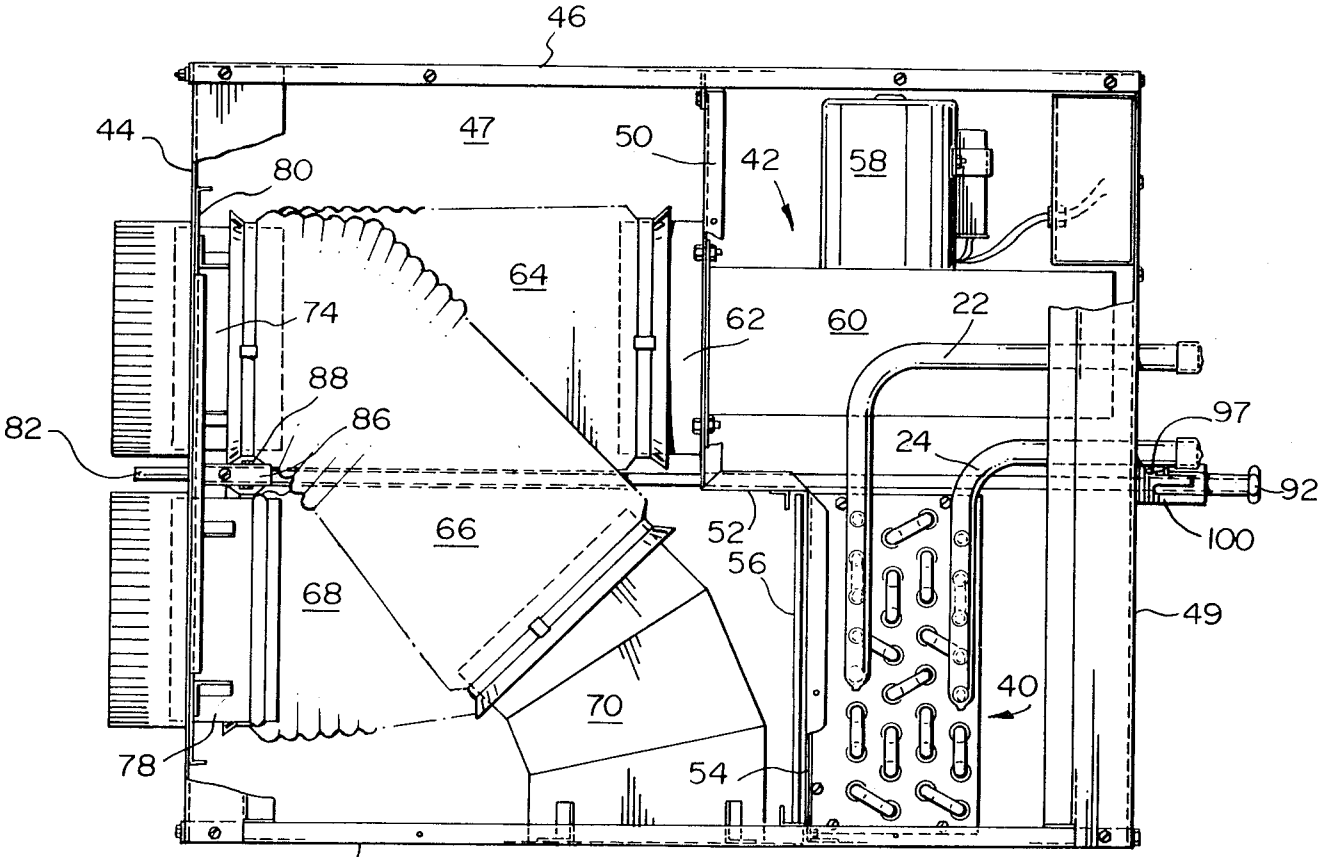
FIG. 2 shows a side view of a fluid flow control valve forming part of the system of FIG. 1, with a housing side wall of the control valve removed.
Figure 3:
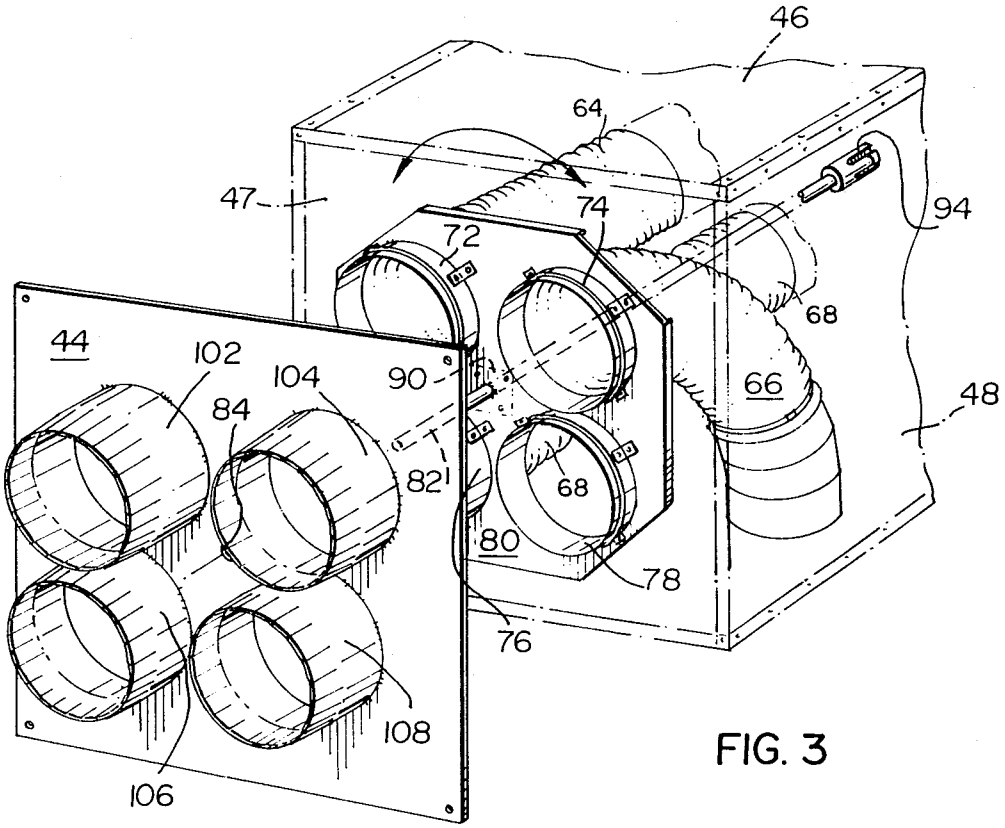
FIG. 3 shows a view in perspective of parts of the control valve of FIG. 1, shown partly separated from one another to facilitate the illustration.

FIG. 4 (which appears on the same sheet as FIG. 1) shows a side view of an actuating rod sleeve forming part of the control valve of FIGS. 2 and 3;

FIGS. 5*a* to 5*c* (which appear on the same sheet as FIG. 1) show views taken in vertical cross-section through duct end connectors or sleeves forming parts of the control valve of FIGS. 2 and 3.

Figure 7:
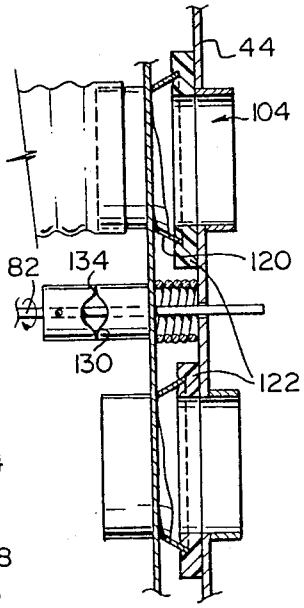
Figure 6:
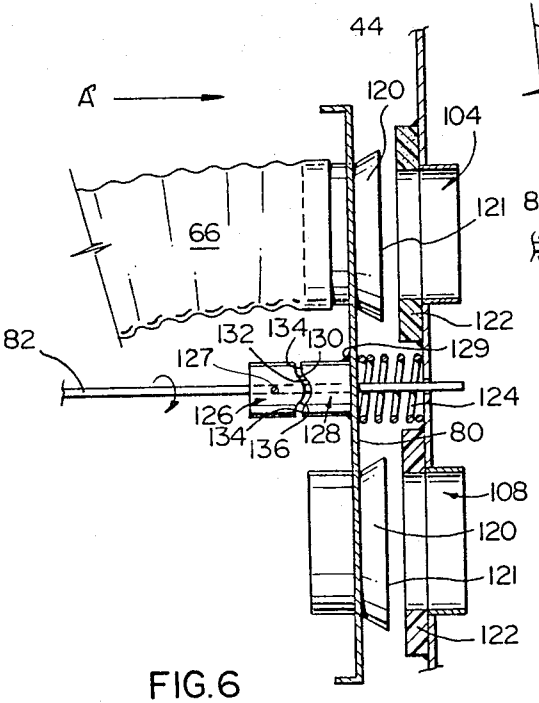

FIG. 6 shows a broken-away view in cross-section through duct end connectors or sleeves, in a further embodiment of the invention, in a released or disconnected condition;

FIG. 7 shows a view corresponding partially to FIG. 6 but with one of the duct end connectors and associated mechanism in a closed or connected position.

Figure 8:
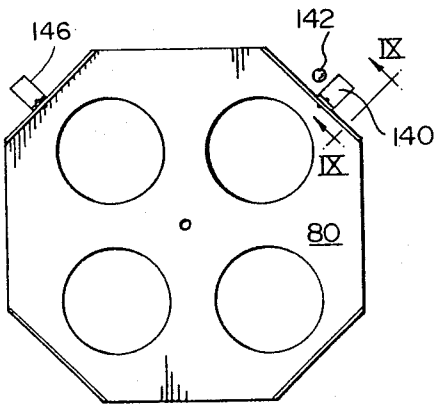
Figure 9:
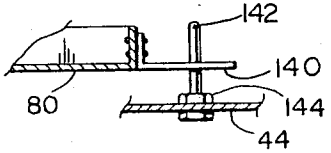

FIG. 8 shows a view in elevation, in the direction of arrow A in FIG. 6, of a rotary plate forming part of the embodiment of FIG. 6; and FIG. 9 shows a broken-away view taken in cross-section, along the line IX—IX of FIG. 8.

DESCRIPTION OF THE PREFERRED EMBODIMENT

Referring firstly to FIGS. 1 and 1*a* of the drawings, which illustrate a cooling and heating system for use in a building, the system has a control valve indicated generally by reference numeral 10, which comprises a heat exchange section 12 and a duct switching section 14, and a heat recovery module, indicated generally by reference numeral 16, which is connected to the duct switching section 14 by a pair of air ducts 18 and 20 and to the heat exchange section by a pair of hot water pipes 22 and 24.

The heat recovery module 16 is also provided with a hot water outlet pipe 26, which is illustrated as being provided with a faucet 28 to indicate diagrammatically a hot water outlet for the supply of domestic hot water to a dwelling.

The duct switching section 14 is also connected to a stale air exhaust duct 30 and to three further air ducts 32, 34 and 36, the duct 32 communicating with the kitchen and bathrooms of the dwelling, the duct 34 communicating with the bedrooms of the dwelling and the duct 36 communicating with the hallways of the dwelling.

The heat recovery module 16, which does not form part of the present invention and which, therefore, will not be described and illustrated in detail herein, comprises a multispeed fan for drawing air through duct 20 and expelling this air through duct 18, freon compressor, a freon evaporator coil, a hot water tank with supplementary electrical heaters and an internal freon condenser and associated controls and connectors, and the function of the heat recovery module is to extract heat from air flowing through the heat recovery module and to transfer this heat to the domestic hot water in the tank. This is effected by a refrigerant cycle, in which heat is extracted either from stale exhaust air from the dwelling, when the system is in a winter operation mode as described in greater detail below or recirculating air from the dwelling, when the system is in its summer operation mode.

The duct switching section 14 is actuatable or adjustable, as described in more detail below, to connect the ducts 18 and 20 to the ducts 34 and 36, respectively, in the summer operation mode, and also to connect the ducts 30 and 32 to the heat exchange section 12 in this mode, as shown in FIG. 1.

On the other hand, in the winter operation mode, as shown in FIG. 1*a*, the ducts 18 and 20 are connected by the duct switching section 14 to the ducts 30 and 32, while the ducts 34 and 36 are connected to the heat exchange section 12.

The heat exchange section 12 has a finned tube hot water coil indicated generally by reference numeral 40, opposite ends of which are connected to the hot water pipes 22 and 24, and a blower, indicated generally by reference numeral 42, for blowing air from the duct switching section 14 over the hot water coil 40.

In the winter operation mode, illustrated in FIG. 1*a*, air is drawn into the duct 34 from the bedrooms of the dwelling, past the hot water coil 40, where it is heated by hot water supplied from the hot water tank in the heat recovery module 16 through the hot water pipes 22 and 24, and the heated air is expelled through the duct 36 into the hallways of the dwelling, as indicated by the dashed lines in FIG. 1*a*.

At the same time, air, passing from the kitchen and bathrooms through the ducts 32 to the heat recovery module provides heat to the evaporator for to convert low pressure freon liquid to low pressure freon gas. A hermetically sealed compressor in the heat recovery module raises the pressure of this freon gas and pumps it through condenser coils located inside the hot water tank in the heat recovery module. The compression raises the temperature of the freon to approximately 60° (140° F.), at which temperature the freon can condense into a liquid when the heat is removed from it in the hot water tank.

The high pressure freon liquid leaving the condenser is then allowed to expand and cool through an expansion valve, and the low pressure freon liquid returns to the evaporator to restart its cycle. The air which has given up its heat in the evaporator is exhausted through the exhaust duct 30.

The water in the tank, which is heated by the condensing freon, rises to the top of the tank by convection, and a temperature sensor mounted at one half of the height of the hot water tank senses when the desired hot water temperature at this point has been reached and indicates that a supply of hot water is available for domestic use. At this time, if there is a demand for heating or cooling of the house, hot water is taken from a height in the tank corresponding to the position of the sensor and is pumped through the hot water coil 40 before being returned to the tank. As mentioned above, in the winter operation mode, this flow of water through the hot water coil 40 is employed to provide heat to air recirculated from the bedrooms to the hallways of the dwelling, this heat being extracted in the above-described manner from the hot water tank in the heat recovery module.

When, on the other hand, the duct switching section 14 is actuated into the condition in which it is shown in FIG. 1, and in which the ducts 34 and 36 are connected to the ducts 18 and 20, as shown by dashed lines, and the ducts 30 and 32 are connected to the heat exchange section 12, as shown by dotted lines, stale air is drawn from the kitchen and bathrooms through the duct 32 by the blower 42 and is thereby passed over the coil 40 to the exhaust duct 30, thus withdrawing heat from the hot water coil 40 and, from the hot water tank in the heat recovery module. This exhaust therefore acts as a sink for the heat produced by the cooling of the air which is drawn into the heat recovery module 16 through the duct 20 and discharged therefrom through the duct 18.

Reference is now made to FIGS. 2 and 3 of the accompanying drawings for a more detailed description of the control valve according to an embodiment of the invention, comprising the duct switching section 14 and the heat exchange section 12.

This control valve has a housing comprising a front panel 44, a bottom panel 45, a top panel 46, opposite side panels 47 and 48 and a rear panel 49. Front panel 44 has four stationary duct sleeves 102, 104, 106 and 108 extending forwardly therefrom for connection to the ends of stationary ducts 30, 34, 36 and 32 respectively.

The interior of this housing is divided into two by a partition which extends to the bottom and top walls 45 and 46 and the side walls 47 and 48 and which comprises a vertical upper panel 50, a horizontal intermediate panel 52 and a vertical bottom panel 54.

The vertical bottom panel 54 is formed with a rectangular opening (not shown) in front of which there is mounted an air filter 56 and behind which there is mounted the finned tube hot water coil 40, the tubes of which are connected to the hot water pipes 22 and 24, as mentioned above.

The blower 42 is mounted above the coil 40 and has a blower motor 58 driving a centrifugal impeller (not shown) which is mounted in an impeller housing 60. The impeller housing 60 has, at its bottom, an inlet opening (not shown), which is downwardly open to and in communication with the coil 40, and an outlet opening (not shown) which communicates through a duct sleeve 62 with a flexible duct 64. The blower 42 therefor serves to draw air within the housing through the filter 56 and the hot water coil 40 into the impeller housing 60 and to expel this air through the flexible duct 64.

Two further flexible ducts 66 and 68 are provided within the housing.

The flexible duct 66 is connected at a lower end thereof through a duct elbow 70 and ,an opening (not shown) in the bottom plate 45 to the air outlet duct 18, and the flexible duct 68 is similarly connected to the air intake duct 20.

The left-hand ends of the flexible ducts 64, 66 and 68, as viewed in FIGS. 2 and 3, are connected to respective duct sleeves 72, 74 and 76, which are provided, together with a further sleeve 78, which defines an opening communicating with the interior of the housing on a rotary plate 80.

As will be described below, movable duct sleeves 72, 74, 76 and 78 sealingly engage stationary duct sleeves 102, 104, 106 and 108. Thus, in the summer, when duct switching section 14 is actuated into the condition in which it is shown in FIGS. 1 and 3, the blower 42 draws air through duct 32, stationary sleeve 108, movable sleeve 78 into the housing from whence it is drawn through coil 40 and expelled through flexible duct 64, stationary sleeve 102 and exhaust duct 30.

Similarly, the fan in heat recovery module (HRM) 16 draws air through stationary duct 36, stationary sleeve 106, flexible duct 68 and thence through the HRM and out flexible duct 66, sleeve 74, stationary sleeve 104 and stationary duct 34.

In the winter, rotary plate 80 is rotated counterclockwise 90° in a manner to be described below to connect movable sleeves 72, 74, 76 and 78 with stationary duct sleeves 106, 102, 108 and 104 respectively to provide the air flow as shown in FIG. 1(*a*). Thus, blower 42 now draws in air through stationary duct 34, stationary sleeve 104, movable sleeve 78 into the housing from whence it is drawn through coil 40 and expelled through flexible duct 64, stationary sleeve 106 and stationary duct 36.

Similarly, the fan in HRM 16 now draws in air through stationary duct 32, stationary sleeve 108, flexible duct 66, sleeve 74, stationary sleeve 102 and exhaust duct 30.

It will be appreciated from the foregoing that whereas the summer/winter changeover reverses the direction of air flow through stationary ducts 34 and 36, the direction of flow through stationary ducts 32 and 30 remains the same at both times of the year.

The rotary plate 80 is mounted on an actuating rod 82, which extends through and is rotatably supported by the front plate 44 and the rear wall 49 of the housing.

More particularly, the actuating rod 82 is journalled in a circular hole 84 in the front plate 44, and a sleeve 86, fixedly secured on the actuating rod 82 by nuts and bolts 88, is welded to a square plate 90 (FIG. 3), which is secured by screws to the rotary plate 80, so that the rotary plate 80 is secured for rotation with the actuating rod 82.

The opposite end of the actuating rod 82 is provided with an actuating handle 92 and with a radially projecting pin 94, which is engageable in either of a pair of axial slots 96 and 98 formed in a sleeve, indicated generally by reference numeral 100 and shown in FIG. 4. The sleeve 100 journals the actuating rod 82 and is secured by screws or welding to the rear surface of the rear wall 49 of the housing.

By pulling the handle 92 to the right, as viewed in FIG. 2, the pin 94 can be displaced axially from the slot 96. This longitudinal displacement of the actuating rod 82 correspondingly displaces the rotary plate 80 to the right, as viewed in FIG. 2, and thus disengages the movable duct sleeves 72, 74, 76 and 78 from stationary duct sleeves 102, 104, 106 and 108 which project forwardly from the front plate 44.

When this axial movement has been completed, the actuating rod 82 can be rotated through 90° to move the pin 94 into alignment with the other slot 98 in the actuating rod sleeve 100, whereupon the actuating rod 82 can be longitudinally displaced to the left, as viewed in FIG. 2, thus engaging the pin 94 in the slot 98 and reengaging the movable duct sleeves on the rotary plate 80 with the stationary duct sleeves on the front plate 44. By this rotation of the actuating rod 82, and therewith the plate 80 and the duct sleeves 72, 74, 76 and 80, the latter are moved out of alignment with the duct sleeves 102, 104, 106 and 108, respectively, so that the duct sleeve 72 is now aligned and engaged with the duct sleeve 104, the duct sleeve 74 is aligned and engaged with the duct sleeve 108, etc. In this way, the changeover of the interconnection of the ducts as described above with reference to FIGS. 1 and 1*a* is readily effected.

A locking pin 97 is insertable through either of a pair of holes 99 in the sleeve 100 into engagement in a hole (not shown) in the actuating rod 82 for correspondingly releasably locking the actuating rod in either of its two positions of rotation.

It should be understood, however, that this arrangement and operation of the sleeve 100 and the pins 94 and 97 are not essential and that various other means may be employed within the scope of the present invention, for releasably retaining the actuating rod 82 and therewith the rotary plate 80 in their two positions of adjustment.

Three alternative sealing arrangements for sealing the duct sleeves at the movable ends of the flexible ducts to the stationary ducts are shown in FIGS. 5*a* to 5*c*.

As shown in FIG. 5*a*, the duct sleeve 74, to which the end of the flexible sleeve 66 is clamped and which extends through the rotary plate 80 for interengagement with the duct sleeve 104, is surrounded by an annular magnetic seal indicated generally by reference numeral 110. The magnetic seal 110 is secured by adhesive to the rotary plate 80 and comprises a magnetic strip 112 embedded in a plastic extrusion 114, the magnetic strip 112 being attracted by the stationary front plate 44, when moved into sufficient proximity thereto, to adhere magnetically in sealing engagement with the front plate 44 around the duct sleeve 104.

FIGS. 5*b* and 5*c* show two different ring seals, indicated by reference numerals 116 and 118, respectively, which are engaged in recesses formed in the duct sleeve 74 and which, on interengagement of the latter into the duct sleeve 104, are compressed into sealing engagement with the inner periphery of the duct sleeve 104.

Referring now to the embodiment of the invention illustrated in FIGS. 6 and 7 of the accompanying drawings, it will be observed that this embodiment again employs the front panel 44 of the control valve, with duct sleeves 104 and 108 being shown projecting from the front panel 44. It is to be understood that the front panel 44 also has projecting therefrom the duct sleeves 102 and 106 of FIG. 3.

In the present embodiment, also, the actuating rod 82 is again journalled in the front panel 44, and the rotary plate 80 is again carried by the actuating rod 82.

In this embodiment, however, the flexible ducts, of which the flexible ducts 66 and 68 are shown in FIG. 6, are connected to duct sleeves 120, which project from the rotary plate 80 and which are radially outwardly flared at their outer ends, i.e. at their right-hand ends as viewed in FIG. 6. These duct sleeves 120 have sheet metal edges 121 which cooperate with annular seals 122, extending around the inner ends of the duct sleeves 104 and 108 and made of a closed cell polyurethane foam material.

For completeness, it is mentioned that the rotary plate 80 is provided with four of the duct sleeves 120, which cooperate with the four duct sleeves projecting from the front plate 44 and with four corresponding annular foam sealing members 122.

The rotary plate 80 is urged rearwardly, i.e. to the left as viewed in FIG. 6, along the actuating rod 82 by means of a compression spring 124, which extends around the actuating rod 82 and is seated against the front plate 44 and the rotary plate 80.

The movement of the rotary plate 80 along the actuating rod 82 under the action of the compression spring 124 is limited by interengagement of first and second cam members 126 and 128. For convenience of illustration, these cam members are shown slightly separated from one another in FIGS. 6 and 7 but it is to be understood that they are, in fact, in mutual sliding contact.

The first cam member 126 is fixedly secured to the actuating rod 82 by a transverse pin 127, and the second cam member 128 is fixed to the rotary plate 80 by weld 129 and has a sliding fit on the actuating rod 82.

The first cam member 126 has an annular cam surface which is formed with raised cam portions 130 at diametrically opposite locations.

The second cam member 128 is formed with a complimentary cam surface, having diametrically opposed recessed cam portions, one of which is indicated by reference numeral 132, and which are substantially complimentary to the raised cam portions 130 of the first cam member 126. The recessed cam portions 132 of the second cam member 128 are located between a pair of raised cam portions 134 of the first cam member 128, which are diametrically opposite to one another and which, with the first and second cam members 126 and 128 disposed as illustrated in FIG. 6, are axially opposed to a pair of recessed cam portions 136 of the first cam member 126.

In order to displace the rotary plate 80 and, therewith, the duct sleeves 120 to the right, as viewed in FIG. 6, along the axis of the actuating rod 82, the latter is rotated to displace the raised portions 130 of the first cam member 126 from the positions in which they are shown in FIG. 6 to the positions in which they are shown in FIG. 7, and in which they are axially opposed to the raised cam portions 134 of the second cam member 128. During such rotation of the actuating rod 82, the cam surfaces of the cam members 126 and 128 slide over one another to produce a camming action which displaces the rotary plate 80 from the position in which it is shown in FIG. 6 to that in which it is shown in FIG. 7, thus pressing the edges 121 of the duct sleeves 120 into the resilient annular foam seals 122, so that the relatively narrow edges 121 resiliently penetrate the seals 122 for tight sealing engagement therewith, in order to seal the flexible ducts 66, 68, etc. to their respective duct sleeves 104, 108, etc.

During the rotation of the actuating rod 82, which will normally commence with the first and second cam members 126 and 128 located relative to one another as shown in FIG. 7, i.e. with the duct sleeves 120 pressed against their foam seals 122, the second cam member 128 initially remains stationary, while the first cam member 126 rotates together with the actuating rod 82 to allow interengagement of the raised cam portions 130 thereof with the recess cam portions 132 of the second cam member 128. As this occurs, the rotary plate 80 can move to the left, as viewed in FIGS. 6 and 7, under the action of the compression spring 124, thus releasing the duct sleeves 120 from the foam seals 122. The rotary plate 80 can then rotate together with the actuating rod 82 through 90°, i.e. to displace each of the duct sleeves 120 from one to another of the duct sleeves 104, 108, etc.

When the rotary plate 80 has completed its rotation through 90°, the rotation of the rotary plate 80 is terminated by abutment of a lug 140, projecting from the plate 80, against a stop pin 142 secured by nuts 144 to the front panel 44, whereupon the raised portions 130 of the first cam member 126 slide from the recessed portions 132 of the second cam member 128, and the camming action between the two cam members 126 and 128 displaces the rotary plate 80, and therewith the duct sleeves 120, to the right as viewed in FIGS. 6 and 7, until the ends of the duct sleeves 120 are again pressed into sealing engagement with the annular foam seals 122.

When the actuating rod 82 is rotated in the opposite direction, a similar sequence of events occurs, the rotation of the rotary plate 80 being limited by abutment of another lug 146 on the rotary plate 80 against the stop pin 142.

The use of the annular foam seals 122 has the advantage that it is not necessary for the duct sleeves 120 to be extremely accurately located with respect to the fixed duct sleeves 102 to 108 when the former are sealed to the latter, so that this embodiment is very tolerant of manufacturing inaccuracies and consequential misalignment and distortion on the components of the apparatus, while still providing a tight seal at loadings which are acceptable to the relatively light structure of the apparatus.

Also, the use of the two above-described cam members 126 and 128 simplifies the operations of effecting both axial and rotational displacement of the movable duct sleeves and thus, for example, facilitates the use of an electric motor for effecting the rotation of the actuating rod for this purpose.

As will be apparent to those skilled in the art, various modifications may be made in the above-described apparatus. It is to be understood, therefore, that the invention may be varied within the scope of the claims appended hereto.

I claim:

1. A fluid flow control valve, comprising:

a rotary member mounted for rotation about a predetermined axis of rotation;

means for rotating said rotary member back and forth about said axis of rotation between first and second positions;

a plurality of stationary first ducts distributed about said axis of rotation;

a plurality of flexible second ducts for communication with respective ones of said first ducts;

said second ducts each having an end movable from one to another of said first ducts on rotation of said rotary member from said first position to said second position;

housing means for enclosing said second ducts in a fluid tight manner, said rotary member defining an additional opening communicating with the interior of said housing means and movable to selectively connect either one of a pair of said first ducts to the interior of said housing means by the rotation of said rotary member between said first and second positions;

means for releasably sealing said ends of said second ducts to respective ones of said first ducts;

means for displacing said rotary member along said axis of rotation upon rotation of said rotary member about said axis of rotation, said displacing means comprising spring means for urging said rotary member in one direction along said axis of rotation;

cam means for displacing said rotary member in the opposite direction; and stop means for limiting the rotation of said rotary member to thereby define said first and second positions, said cam means being effective to rotate said rotary member between said first and second positions.

2. A fluid flow control valve, comprising:

a rotary member mounted for rotation about a predetermined axis of rotation;

means for rotating said rotary member back and forth about said axis of rotation between first and second positions;

a plurality of stationary first ducts distributed about said axis of rotation;

a plurality of flexible second ducts for communication with respective ones of said first ducts;

said second ducts each having an end movable from one to another of said first ducts on rotation of said rotary member from said first position to said second position;

housing means for enclosing said second ducts in a fluid tight manner, said rotary member defining an additional opening communicating with the interior of said housing means and movable to selectively connect either one of a pair of said first ducts to the interior of said housing means by the rotation of said rotary member between said first and second positions;

means for releasably sealing said ends of said second ducts to respective ones of said first ducts;

blower means for impelling air from the interior of said housing means through one of said second ducts; and means within said housing means for modifying the temperature of said air during passage of said air from said additional opening to said one of said second ducts.

3. A fluid flow control valve as claimed in claims 2 or 1, including a plurality of tubular duct connection members extending through corresponding openings in said rotary member, said control valve further comprising means securing one end of each of said second ducts around a respective one of said duct connection members at one side of said rotary member and said sealing means comprising resilient seals extending around said duct connection members at the other side of said rotary member.

4. A fluid flow control valve as claimed in claim 3, further comprising a stationary member adjacent said rotary plate, said stationary member having a plurality of openings for receiving said duct connection members, said first ducts being secured to said stationary member around said openings and said rotary member being movable along said axis of rotation for matingly engaging and disengaging said duct connection members with said openings.

5. A fluid flow control valves as claimed in claim 2, wherein said sealing means comprise resilient annular sealing means for resilient sealing engagement with said first and of said second ducts, said annular sealing means being secured in position relative to said first ducts.

6. A fluid flow control valve as claimed in claim 5, wherein said ends of said second ducts comprise narrow edges capable of resiliently penetrating said annular sealing means for tight sealing engagement therewith.

7. A fluid flow control valve as claimed in claim 5 or 6, wherein said annular sealing means comprise foam material.

8. A fluid flow control valve as claimed in claim 2, further comprising means for displacing said rotary member along said axis of rotation upon rotation of said rotary member about said axis of rotation, said displacing means comprising spring means for urging said rotary member in one direction along said axis of rotation, cam means for displacing said rotary member in the opposite direction and stop means for limiting the rotation of said rotary member to thereby define said first and second positions said cam means being effective to rotate said rotary member between said first and second positions.

9. A fluid flow control valve, comprising:

a rotary member mounted for rotation about a predetermined axis of rotation;

means for rotating said rotary member back and forth about said axis of rotation between first and second positions;

a plurality of stationary first ducts distributed about said axis of rotation;

a plurality of flexible second ducts for communication with respective ones of said first ducts;

said second ducts each having a first end simultaneously movable from one to another of said first ducts on rotation of said rotary member from said first position to said second position, and a second end fixedly secured to maintain the same point of connection notwithstanding rotation of said rotary member; and means for releasably sealing said ends of said second ducts to respective ones of said first ducts.

10. A fluid flow control valve as claimed in claim 9, further comprising housing means for enclosing said second ducts in a fluid tight manner, said rotary member defining an additional opening communicating with the interior of said housing means and movable to selectively connect either one of a pair of said first ducts to the interior of said housing means by the rotation of said rotary member between said first and second positions.

11. A fluid flow control valve as claimed in claim 10, wherein said sealing means comprise resilient annular sealing means for resilient sealing engagement with said first ends of said second ducts, said annular sealing means being secured in position relative to said first ducts.

12. A fluid flow control valve as claimed in claim 11, wherein said ends of said second ducts comprise narrow edges capable of resiliently penetrating said annular sealing means for tight sealing engagement therewith.

13. A fluid flow control valve as claimed in claim 12, wherein said annular sealing means comprise foam material.

14. A fluid flow control valve as claimed in claim 13, further comprising means for displacing said rotary member along said axis of rotation upon rotation of said rotary member about said axis of rotation, said displacing means comprises spring means for urging said rotary member in one direction along said axis of rotation, cam means for displacing said rotary member in the opposite direction and stop means for limiting the rotation of said rotary member to thereby define said first and second positions, said cam means being effective to rotate said rotary member between said first and second positions.

15. A fluid flow control valve as claimed in claim 14 further comprising blower means for impelling air from the interior of said housing means through one of said second ducts and means within said housing means for modifying the temperature of said air during passage of said air from said additional opening to said one of said second ducts.

* * * * *

UNITED STATES PATENT AND TRADEMARK OFFICE

CERTIFICATE OF CORRECTION

PATENT NO. : 4,867,232

DATED : September 19, 1989

INVENTOR(S) : John M. DEWILL

It is certified that error appears in the above-identified patent and that said Letters Patent is hereby corrected as shown below:

The surname of the inventor should read: DEWIL.

Signed and Sealed this

Nineteenth Day of February, 1991

*Attest:*

HARRY F. MANBECK, JR.

*Attesting Officer*

*Commissioner of Patents and Trademarks*